US006980185B2

(12) United States Patent
Kang

(10) Patent No.: US 6,980,185 B2
(45) Date of Patent: Dec. 27, 2005

(54) DRIVING MODULE FOR A LIQUID CRYSTAL DISPLAY PANEL AND A LIQUID CRYSTAL DISPLAY DEVICE HAVING THE SAME

(75) Inventor: Sin-Gu Kang, Gyeonggi-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 568 days.

(21) Appl. No.: 09/804,381

(22) Filed: Mar. 13, 2001

(65) Prior Publication Data

US 2001/0022568 A1 Sep. 20, 2001

(30) Foreign Application Priority Data

Mar. 17, 2000 (KR) ..... 2000-13544

(51) Int. Cl.[7] ..... G09G 3/36

(52) U.S. Cl. ..... 345/87; 345/98; 345/206; 345/204; 349/150

(58) Field of Search ..... 345/87, 98, 92, 345/103, 205, 208, 94, 904, 204, 206; 349/147–150, 349/151, 152, 192, 40; 324/770

(56) References Cited

U.S. PATENT DOCUMENTS 5,592,199 A * 1/1997 Kawaguchi et al. ..... 345/206
5,739,887 A 4/1998 Ueda et al. ..... 349/149
5,838,400 A 11/1998 Ueda et al. ..... 349/58
5,945,984 A * 8/1999 Kuwashiro ..... 345/206
5,959,713 A * 9/1999 Kobayashi ..... 349/192
6,411,359 B1 * 6/2002 Kobayashi et al. ..... 349/149
6,590,624 B1 * 7/2003 Lee ..... 349/54
6,624,857 B1 * 9/2003 Nagata et al. ..... 349/54
6,639,589 B1 * 10/2003 Kim et al. ..... 345/206

FOREIGN PATENT DOCUMENTS

CN 1231463 A 10/1999
EP 0518068 A1 5/1992

* cited by examiner

*Primary Examiner*—Regina Liang
*Assistant Examiner*—Jennifer T. Nguyen
(74) *Attorney, Agent, or Firm*—McGuireWoods LLP

(57) ABSTRACT

Disclosed are a driving module for a liquid crystal display panel and a liquid crystal display device capable of inspecting the effectiveness of a driving signal applied to a display cell circuit of the liquid crystal panel and a wiring state of driving signal input/output lines. The display cell circuit provided in the liquid crystal display panel is connected to a gate line and a data line. The liquid crystal display panel displays an image in response to gate and data driving signals inputted through the gate and data lines. An integrated printed circuit board generates gate and data driving signals. A data driving module is electrically connected between the integrated printed circuit board and the data line to control the time for applying the data driving signal. A gate driving module has a plurality of gate driving signal input/output lines connected to the gate line. The gate driving module provides the gate driving signal to the gate line by controlling the time for applying the gate driving signal and inspects the states of the gate driving signal and the gate driving signal input/output lines. The wiring state of the gate driving signal input/output lines, which are formed in the integrated printed circuit board by passing through the gate driving module, and the effectiveness of the driving signal supplied to the gate line through the gate driving signal input/output lines can be easily inspected.

20 Claims, 6 Drawing Sheets

DRIVING MODULE FOR A LIQUID CRYSTAL DISPLAY PANEL AND A LIQUID CRYSTAL DISPLAY DEVICE HAVING THE SAME

CROSS REFERENCE TO PRIOR APPLICATIONS

This application claims priority from Korean Patent Application No. 2000-13544 filed Mar. 17, 2000, which is hereby incorporated by reference for all purposes as if fully set forth herein.

BACKGROUND OF THE INVENTION

1. Field of the Invention

The present invention relates to a liquid crystal display device, and more particularly to a driving module for a liquid crystal display panel and a liquid crystal display device having the same capable of inspecting the effectiveness of a driving signal applied to a display cell circuit of the liquid crystal panel and a wiring state of driving signal input/output lines.

2. Description of the Related Art

Recently, as information technology is developed, information processing devices, such as computers, make great strides. The advance of the information processing technology leads to the development of the monitor device which displays information outputted from the information processing device.

The monitor device is generally classified into a CRT (cathode ray tube) type monitor device which uses the features of the CRT, and a liquid crystal unit type monitor device which adopts physical and optical features of liquid crystal. The liquid crystal unit type monitor device has a compact size and a light weight with a low power consumption as compared with the CRT type monitor device. As a result, the liquid crystal unit type monitor device is widely used as a display device of a portable computer, as a monitor of a desk top computer and as a monitor of a high definition visual instrument.

FIG. 1 shows an exploded perspective view of a conventional liquid crystal display device 100.

Referring to FIG. 1, the liquid crystal display device 100 has a liquid crystal display module 130 which displays an image by receiving an image signal, a front case 110 and a rear case 120 that are coupled to each other so as to receive the liquid crystal display module 130. The liquid crystal display module 130 includes a display unit 170 and a back light assembly 150 for providing a light to the display unit 170.

The display unit 170 has a liquid crystal display panel 171 for displaying the image, a data side printed circuit board 176, a gate side printed circuit board 175, a data side tape carrier package 178 and a gate side tape carrier package 174.

The liquid crystal display panel 171 has a thin film transistor substrate 172, a color filter board 173 and a liquid crystal (not shown).

The thin film transistor substrate 172 is a transparent glass substrate on which thin film transistors arranged in a matrix are formed. Data lines are connected to a source terminal of the thin film transistor, and gate lines are connected to a gate terminal of the thin film transistor. In addition, pixel electrodes consisting of indium tin oxide (ITO), which is transparent conductive material, is formed on a drain terminal of the thin film transistor.

The color filter board 173 is positioned opposite to the thin film transistor substrate 172. R.G.B pixels are formed on the color filter board 173 by a thin film manufacturing process. When the light passes through the R.G.B pixels of the color filter board 173, predetermined colors are generated. A common electrode of ITO is coated on a front portion of the color filter board 173.

When the electric power is applied to gate and source terminals of the transistor of the thin film transistor substrate, the thin film transistors are turned-on so that an electric field is formed between the pixel electrode and the common electrode of the color filter board. Alignment angles of molecules of the liquid crystal injected between the thin film transistor substrate 172 and the color filter board 173 are changed by the electric field, so the light transmission rate according to the alignment angles of molecules of the liquid crystal so that desired pixels are obtained.

In order to control the alignment angles and alignment time of molecules of the liquid crystal, a driving signal and a timing signal are applied to the gate line and the data line of the thin film transistor, respectively. As shown in FIG. 1, the data side tape carrier package 178, which is a flexible printed circuit board, is attached to the source side of the liquid crystal display panel 171 for applying the data driving signal. In addition, the gate side tape carrier package 174, which is a flexible printed circuit board, is attached to the gate side of the liquid crystal display panel 171 for applying the gate driving signal.

The data side printed circuit board 176 and the gate side printed circuit board 175, which apply driving signals to the data line and the gate line by receiving the image signal from outside, are connected to the data side tape carrier package 178 and the gate side tape carrier package 174, respectively. A source part receives the image signal from an information processing device (not shown), such as a computer, and applies the data driving signal to the liquid crystal display device 171. The source part is formed on the data side printed circuit board 176. A gate part is formed on the gate side printed circuit board 175 so as to apply the gate driving signal to the gate line of the liquid crystal display panel 171. That is, the data side printed circuit board 176 and the gate side printed circuit board 175 generates the gate driving signal, the data driving signal and a plurality of timing signals for determining the time for applying the gate and data driving signals, so that the gate driving signal is applied to the gate line through the gate side tape carrier package 174 and the data driving signal is applied to the data line through the data side tape carrier package 178.

The back light assembly 150 is provided below the display unit 170 so as to uniformly apply the light to the display unit 170. The back light assembly 150 has a lamp unit 151 which is positioned at an end portion of the liquid crystal display module 130 so as to generate the light, a light guide plate 152 for guiding the light towards the display unit 170, a plurality of optical sheets 153 for making the luminance of the light irradiated from the light guide plate 152 to be uniform, and a reflection plate 154 which is positioned below the light guide plate 152 so as to reflect the light leaking from the light guide plate 152, thereby improving the light efficiency.

The display unit 170 and the back light assembly 150 is fixedly supported by a mold frame 131, which is a container for receiving the display unit 170 and the back light assembly 150. A chassis 140 is provided to secure the position of the display unit 170.

As thin film manufacturing technology develops, controllers placed in the gate side printed circuit board 175 for processing the gate signal can be placed in the data side printed circuit board 176 without enlarging the area of the data side printed circuit board 176. That is, signal transmission lines for transmitting the gate driving signal or other signals are only formed in the data side printed circuit board 176 so as to transmit the gate driving signal inputted from the data side printed circuit board 176 to the gate line through the gate side tape carrier package 174.

However, in the above-mentioned conventional liquid crystal display device, it is impossible to inspect the wiring state of the signal transmission lines for the gate and the effectiveness of the gate driving signal. Particularly, since the gate side printed circuit board 175 is integrated with the data side printed circuit board 176, only are the signal transmission lines for the gate driving signal complicatedly formed in the gate side tape carrier package 175 so that the wiring state of the signal transmission lines and the effectiveness of the driving signal cannot be properly inspected.

SUMMARY OF THE INVENTION

Therefore, it is a first object of the present invention to provide a driving module capable of inspecting the effectiveness of a driving signal applied to a display cell circuit of a liquid crystal panel and inspecting the wiring state of driving signal input/output lines.

A second object of the present invention is to provide a liquid crystal display device having the driving module.

To achieve the first object of the present invention, there is provided a driving module for applying a driving signal to a display cell circuit formed on a transparent substrate through a plurality of signal transmission lines, the driving module comprising a flexible board; a driving circuit mounted on the flexible board;

a plurality of driving signal input/output lines that are electrically communicated with the driving circuit and the display cell circuit so as to input/output the driving signal; and an inspecting part formed on the plurality of driving signal input/output lines for inspecting states of the plurality of driving signal input/output lines and the driving signal.

To achieve the second object of the present invention, there is provided a liquid crystal display device comprising: a liquid crystal display panel having a plurality of first and second signal transmission lines and display cell circuits which are connected to pairs of first and second signal transmission lines, the liquid crystal display panel displaying an image in response to first and second driving signals inputted through the first and second signal transmission lines; an integrated printed circuit board for generating the first and second driving signals; a plurality of first driving modules that are electrically connected between the integrated printed circuit board and the plurality of first signal transmission lines so as to transmit the first driving signal to the first signal transmission lines by controlling a time for applying the first driving signal of the integrated printed circuit board; and a plurality of second driving modules having a plurality of driving signal input/output lines connected to the plurality of second signal transmission lines. The second driving modules transmit the second driving signal to the second signal transmission lines by controlling the time for applying the second driving signal of the integrated printed circuit board. The second driving modules inspect states of the second driving signal and the plurality of driving signal input/output lines.

According to the preferred embodiment of the present invention, the plurality of driving signal input/output lines are formed at a side of the transparent substrate, that is at a side of the liquid crystal display panel. The plurality of driving signal input/output lines includes a plurality of gate driving signal input lines that are formed on the flexible board for providing the gate driving signal to the gate driving circuit, a plurality of gate driving signal bypass lines formed on the flexible board for providing the gate driving signal supplied from the gate driving circuit to a next circuit and a gate driving signal output line connected between the gate driving circuit and a gate line so as to provide the gate driving signal supplied from the plurality of gate driving signal input lines to the signal transmission lines.

Each of the plurality of gate driving signal input lines is correspondingly connected to each of the plurality of gate driving signal bypass lines in the gate driving circuit. The inspecting part is formed at only one group of the plurality of gate driving signal input lines and the plurality of gate driving signal bypass lines or is separately formed at the plurality of gate driving signal input lines and the plurality of gate driving signal bypass lines.

When the inspecting part is separately formed, the inspecting part is formed at only one of the gate driving signal input line and the gate driving signal bypass line in a line in which a gate driving signal input line is electrically communicated with a gate driving signal bypass line. The inspecting part is formed by point-shaped patterns having an area larger than an area of each gate driving signal input line and gate driving signal bypass line.

According to the driving module for the liquid crystal display panel and the liquid crystal display device, the gate driving signal generated from the integrated printed circuit board is supplied to the gate line through the gate driving signal transmission line that are formed on the thin film transistor substrate by passing through a gate driving IC of the gate driving module. In addition, an inspecting part having a point-shaped pattern is formed on each signal transmission line of the gate driving signal transmission line.

Accordingly, the wiring state of the gate driving signal input/output lines, which are formed in the integrated printed circuit board by passing through the gate driving module, and the effectiveness of the driving signal supplied to the gate line through the gate driving signal input/output lines can be easily inspected.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Hereinafter, a preferred embodiment of the present invention will be described in detail with reference to the accompanying drawings.

Figure 1:
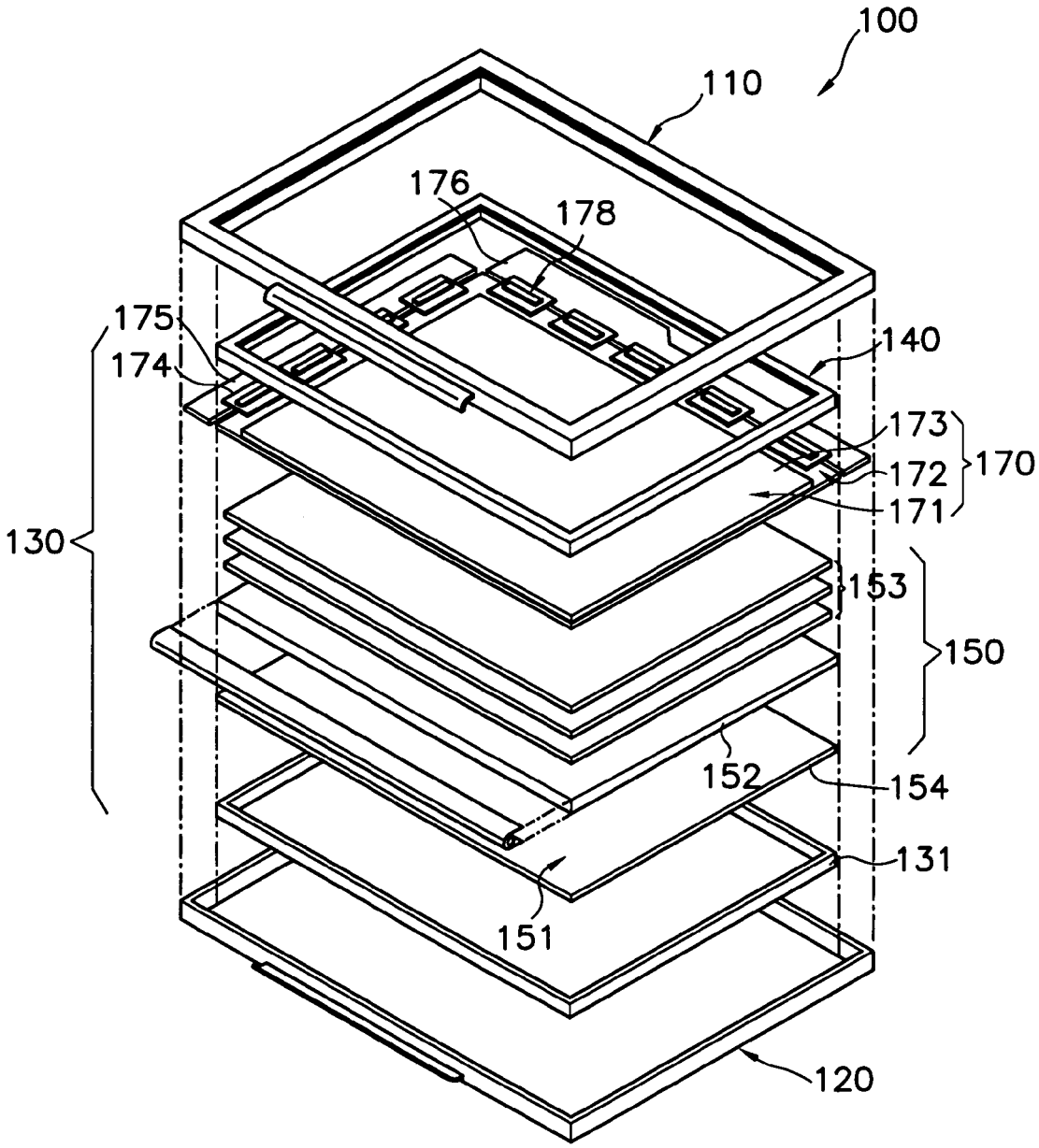
FIG. 1 (PRIOR ART)
FIG. 1 is an exploded perspective view of a conventional liquid crystal display device.
Figure 2:
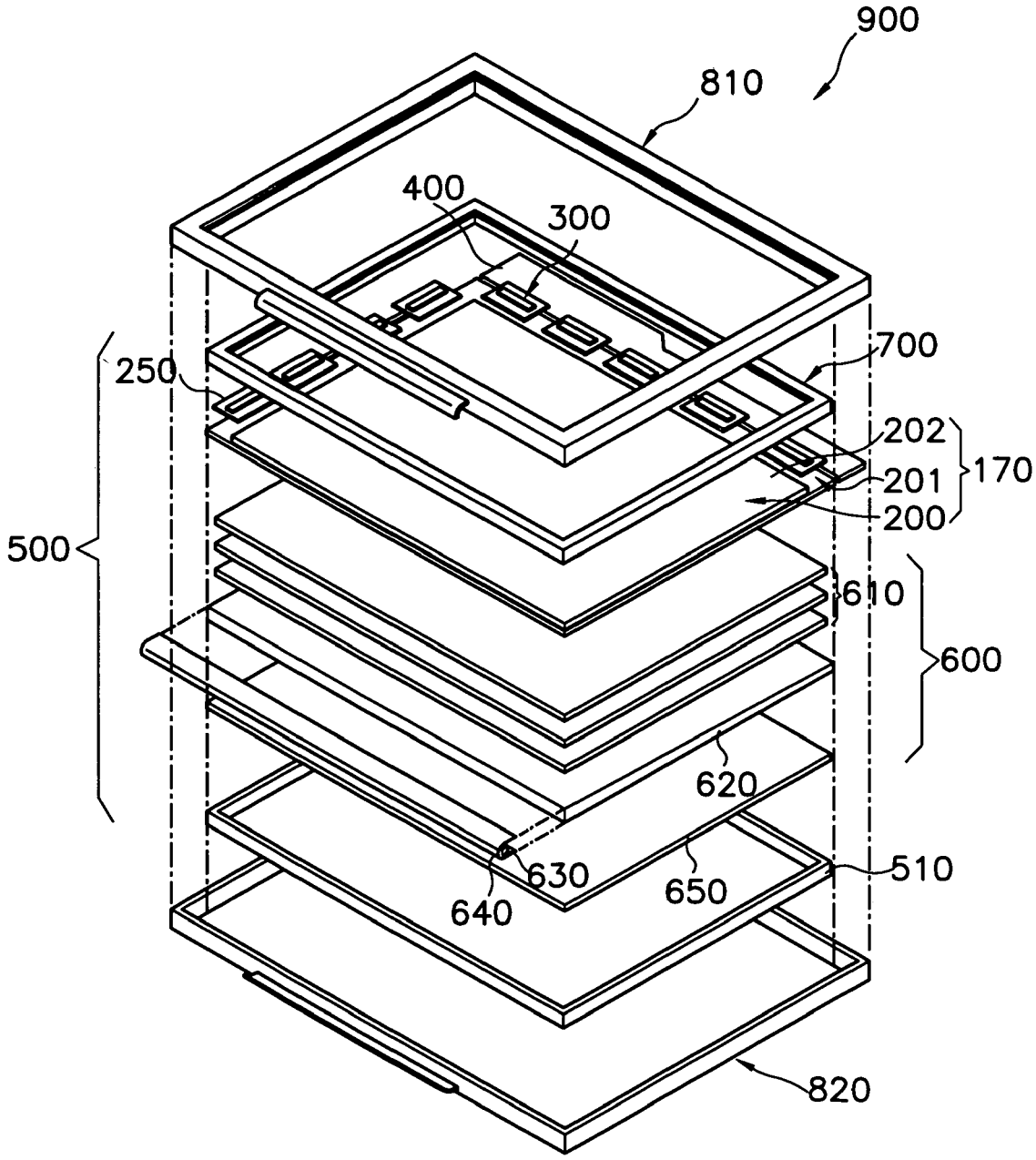
FIG. 2 is an exploded perspective view of a liquid crystal display device according to a preferred embodiment of the present invention.

FIG. 2 is an exploded view showing a liquid crystal display device according to the preferred embodiment of the present invention.

Referring to FIG. 2, the liquid crystal display device 900 has a liquid crystal display module 500 that receives an image signal for displaying an image and a case 800 for containing the liquid crystal display module 500. The case 800 consists of a front case 810 and a rear case 820.

The liquid crystal display module 500 has a display unit having a liquid crystal display panel for displaying an image.

The display unit has the liquid crystal display panel 200, an integrated printed circuit board 400, a data side tape carrier package 300 and a gate side flexible circuit board 250 manufactured by using COF method.

The liquid crystal display panel 200 has a thin film transistor substrate 201, a color filter board 202 and a liquid crystal (not shown).

The thin film transistor substrate 201 is a transparent glass substrate in which transistors are formed in a matrix shape. Data lines are connected to a source terminal of the thin film transistors and gate lines are connected to a gate terminal of the thin film transistors. In addition, pixel electrodes consisting of indium tin oxide (ITO), which are made of transparent conductive material, are formed on a drain terminal of the thin film transistors.

When an electric signal is applied to the data lines and the gate lines, the electrical signal is also applied to the source and gate terminals of the thin film transistors. Accordingly, the thin film transistors are turned on or turned off, so that an electrical signal required to form the pixel is outputted through the drain terminal.

The color filter board 202 is positioned opposite to the thin film transistor substrate 201. R.G.B pixels are formed on the color filter board 202 by a thin film manufacturing process. When the light passes through the R.G.B pixels of the color filter board 202, predetermined colors are generated. A common electrode consisting of ITO is coated on a front portion of the color filter board 202.

When the electric power is applied to gate and source terminals of the thin film transistors of the thin film transistor substrate 201, the thin film transistors are turned-on so that an electric field is formed between the pixel electrode and the common electrode of the color filter board 202. Alignment angles of molecules of the liquid crystal filled between the thin film transistor substrate 201 and the color filter board 202 changes by the electric field, which changes the light transmission rate so that desired pixel images are obtained.

In order to control the alignment angles and alignment time of molecules of the liquid crystal, a driving signal and a timing signal are applied to the gate line and the data line of the thin film transistors, respectively. As shown in FIG. 2, the data side tape carrier package 300, which is a flexible printed circuit board and is referred to a data driving module below, is attached to the source side of the liquid crystal display panel 200 for determining the time for applying the data driving signal. In addition, the gate side flexible printed circuit board 250, which is manufactured by COF method and is referred to a gate driving module below, is attached to the gate side of the liquid crystal display panel 200 for determining the time for applying the gate driving signal.

The integrated printed circuit board 400 is connected to the data driving module 300 at a data line side of the liquid crystal display panel 200. The integrated printed circuit board 400 receives the image signal from the outside of the liquid crystal display panel 200 and applies the driving signal into the gate line and the data line. The integrated printed circuit board 400 includes a source part that receives the image signal from an information processing device (not shown), such as a computer, and applies the data driving signal to the liquid crystal display device 200 and a gate part for applying the gate driving signal to the gate line of the liquid crystal display panel 200.

That is, the integrated printed circuit board 400 generates the gate driving signal, the data driving signal and a plurality of timing signals for determining the time for applying the gate and data driving signals, so that the gate driving signal is applied to the gate line of the liquid crystal display panel 200 through the gate driving module 250 and the data driving signal is applied to the data line of the liquid crystal display panel 200 through the data driving module 300.

The back light assembly 600 is provided below the display unit so as to uniformly apply the light to the display unit. The back light assembly 600 has a lamp unit 630 positioned at an end portion of the liquid crystal display module 500 to provide light. The lamp 630 is protected by a lamp cover 640. A light guide plate 620 has a size corresponding to a size of the liquid crystal panel 200 and guides the light generated from the lamp 630 towards the display unit.

A plurality of optical sheets 610 are provided above the light guide plate 620 for making the uniform luminance of the light irradiated from the light guide plate 620. A reflection plate 650 is positioned below the light guide plate 620 so as to reflect the light leaking from the light guide plate 620, thereby improving the light efficiency.

The display unit and the back light assembly 600 are fixedly supported by a mold frame 510, which is a container for receiving the display unit and the back light assembly 510. A chassis 700 is provided to secure the display unit in its position.

Figure 3:
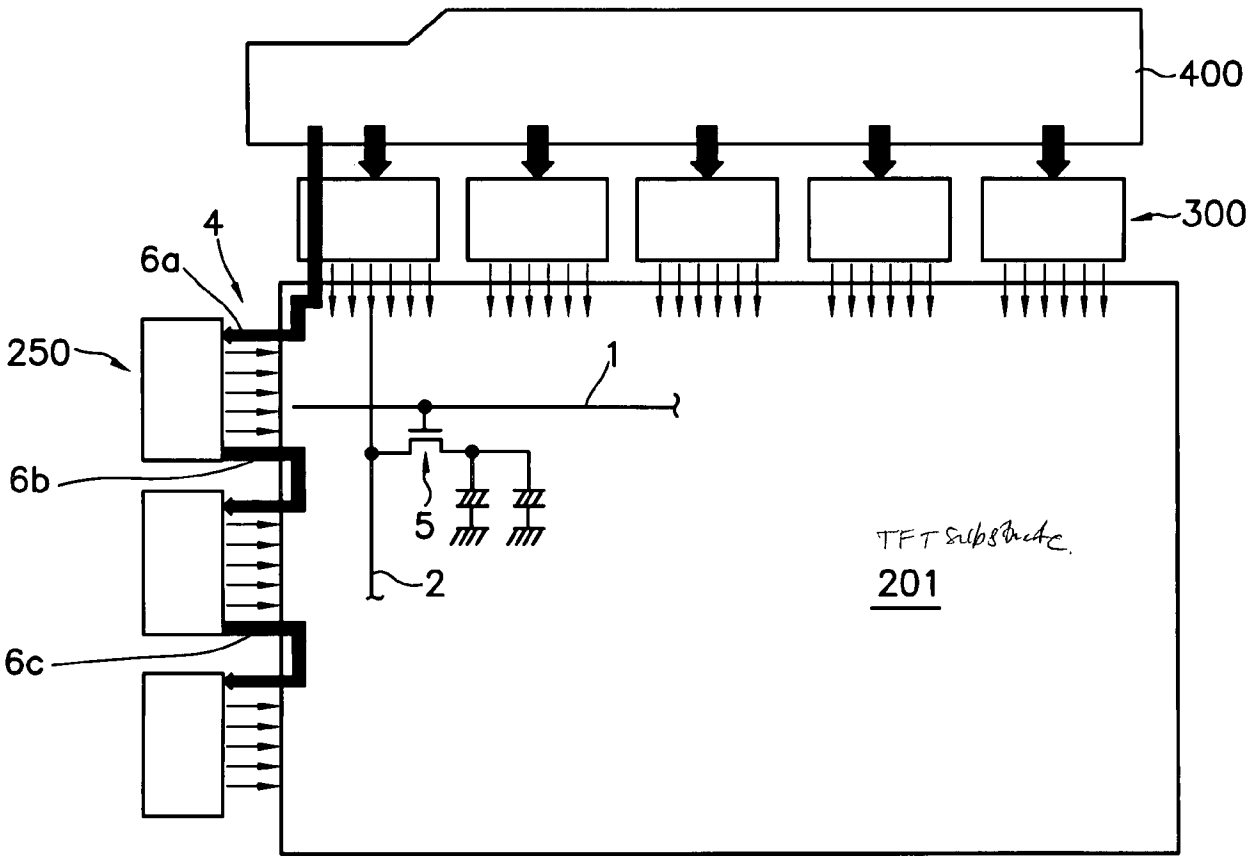
FIG. 3 is a schematic view for explaining the driving state of a liquid crystal display panel assembly of the liquid crystal display device shown in FIG. 2.

FIG. 3 shows the liquid crystal display panel assembly of the liquid crystal display device having the structure as mentioned above. FIG. 3 is a schematic view for explaining the driving state of the liquid crystal display panel assembly of the liquid crystal display device shown in FIG. 2.

Referring to FIG. 3, the data driving module 300 is electrically connected to one end of the thin film transistor substrate 201. The gate driving module 250 is electrically connected to the other end of the thin film transistor substrate 201. The other end of the data driving module 300 is connected to the integrated printed circuit board 400 which generates the gate driving signal for driving the gate driving module 250, the data driving signal for driving the data driving module 300 and the plurality of timing signals for determining the time for applying the gate and data driving signals.

Pluralities of data lines are formed on the thin film transistor substrate 201 in the form of a column 2, and the data driving signal is applied to the data lines through the data driving module 300. In addition, pluralities of gate lines are formed on the thin film transistor substrate 201 in the form of a row 1, and the gate driving signal is applied to the gate lines through the gate driving module 250. A thin film transistor 5 is formed on the thin film transistor substrate 201 in a matrix form. A source terminal S and a gate terminal G of the thin film transistor 5 are connected to the data line 2 and the gate line 1, respectively. A drain terminal of the thin film transistor 5 is grounded by interposing the pixel electrode.

After the predetermined electric power is applied to the data lines 2, the electric power is sufficiently applied to one of gate lines 1 so as to turn on the thin film transistor 5. Then, the thin film transistor 5 connected to the gate line 1 is turned on so that the electric power is supplied to the pixel electrode. At this time, the electric field is formed between the pixel electrode of the thin film transistor substrate 201 and the common electrode of the color filter board 202. Accordingly, molecules of the liquid crystal are rearranged proportional to the intensity of the electric filed. The molecules of the liquid crystal keep the state due to the storage capacitance between the pixel electrode and the common electrode. By using the optical features of the liquid crystal, the amount of the electric power applied to the data line 2 and the timing for applying the electric power to the gate line 1 are properly adjusted so that required image can be displayed through the liquid crystal display device 900.

Since a gate controller and a data controller are placed in the integrated printed circuit board 400, a first output terminal for the gate driving signal and a second output terminal for the data driving signal are installed together.

Figure 4:
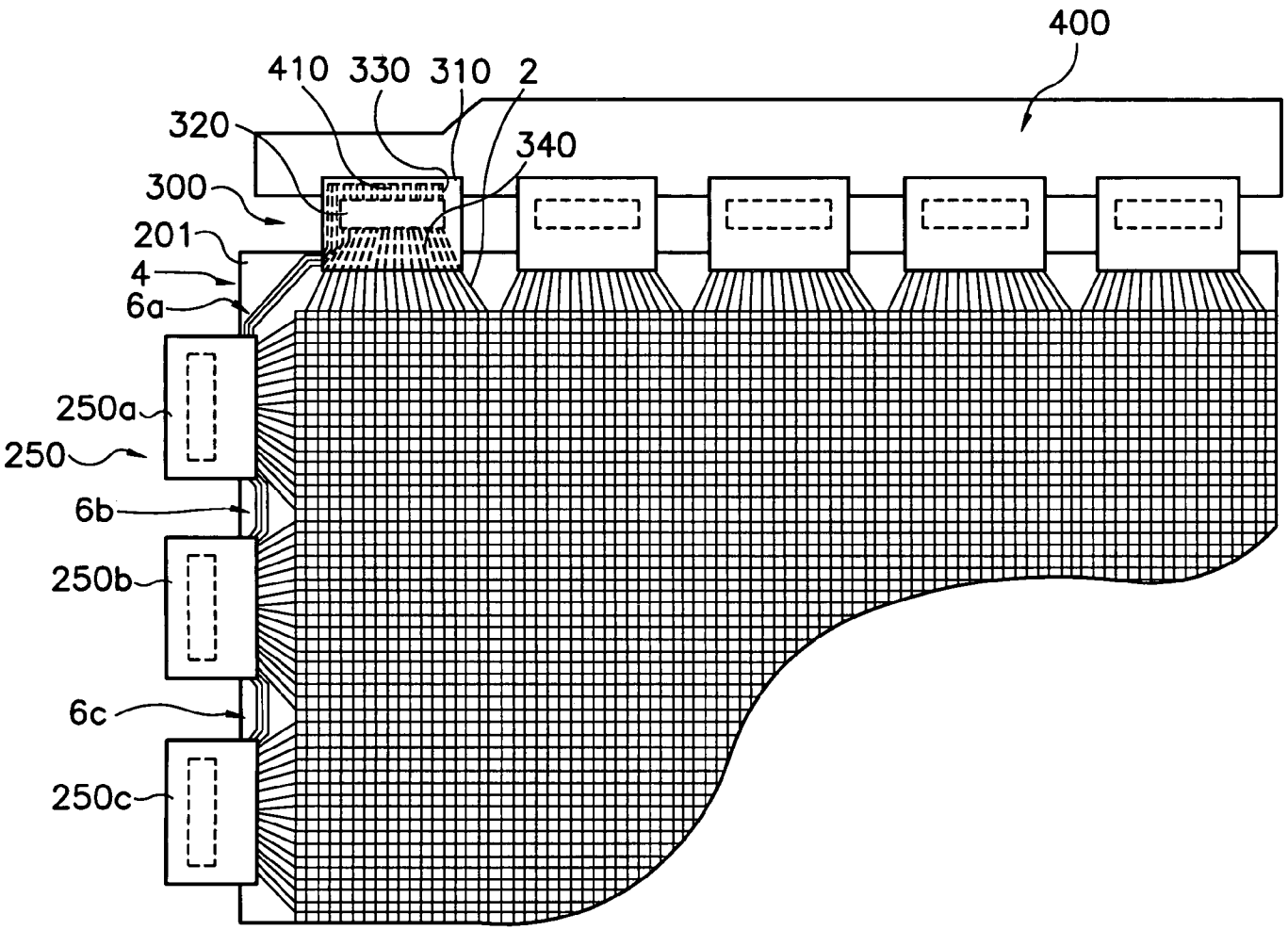
FIG. 4 is a schematic view showing the liquid crystal display panel in which a color filter board is removed.

FIG. 4 shows the structures of the first and second output terminals formed in the data driving module 300.

Referring to FIG. 4, the data driving module 300 has a flexible base substrate 310, a driving integrated circuit 320 which is referred to as a driving IC below, a data driving signal input line 330 which transmits the data driving signal from the integrated printed circuit board 400 to the driving IC 320, a data driving signal output line 340 for supplying the data driving signal to the data lines 2, and a gate driving signal transmission line 4 which supplies the gate driving signal from the integrated printed circuit board 400 to the gate driving module 250.

The number of the gate driving module 250 is corresponding to the number of the gate lines I formed on the thin film transistor substrate 201. In this embodiment, first to third gate driving modules 250*a,* 250*b* and 250*c* are installed.

Figure 5:
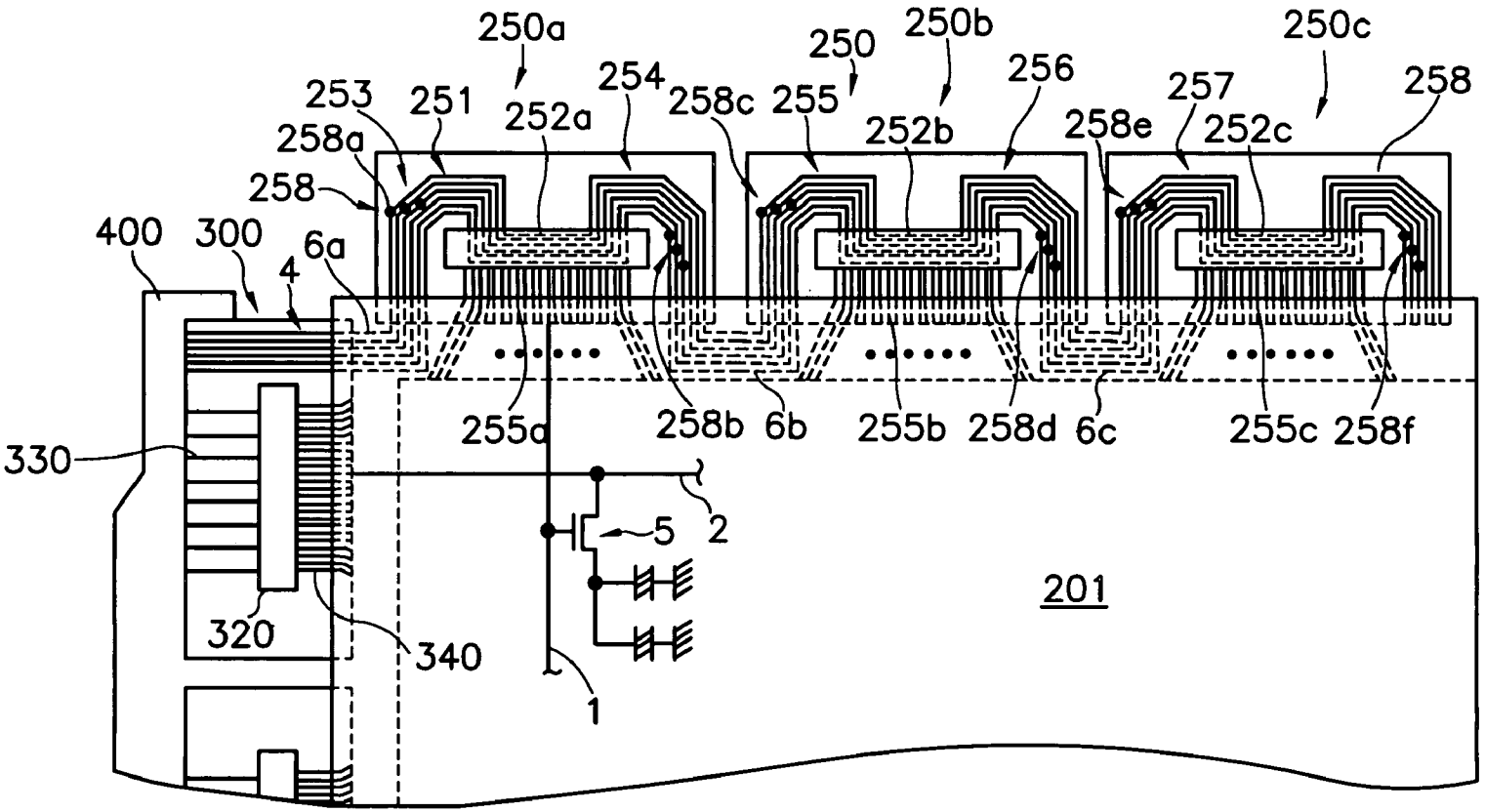
FIG. 5 is a schematic view showing a driving module of the liquid crystal display panel shown in FIG. 4 formed with inspecting patterns according to one embodiment of the present invention.

Referring to FIG. 5 the gate driving signal transmission line 4, a part of which is installed at the data driving module 300, is arranged on the integrated printed circuit board 400 and extends passing through the data driving module 300, the thin film transistor substrate 201, and the first to third gate driving module 250*a,* 250*b* and 250*c*. First to third gate driving ICs 252*a,* 252*b* and 252*c* are formed on the first to third gate driving module 250*a,* 250*b* and 250*c,* respectively.

For the purpose of explaining, portions of the gate driving signal transmission line 4 formed on the thin film transistor substrate 201 are referred to first to third gate driving signal transmission lines 6*a,* 6*b* and 6*c*. In addition, portions of the gate driving signal transmission lines 4, which are connected to allow the gate driving signal to be supplied from the thin film transistor substrate 201 to the first to third gate driving ICs 252*a,* 252*b* and 252*c,* are referred to first to third gate driving signal input lines 253, 255 and 257. Portions of the gate driving signal transmission lines 4, which are connected between the first to third gate driving ICs 252*a,* 252*b* and 252*c* and first to third gate driving signal transmission lines 6*a,* 6*b* and 6*c* in order to supply the gate driving signal to next gate driving module, are referred to first to third gate driving signal bypass lines 254, 256 and 258. In addition, portions of the gate driving signal transmission lines 4, which are connected to allow the gate driving signal to be transferred from the first to third gate driving ICs 252*a,* 252*b* and 252*c* to the gate line of the thin film transistor substrate 201, are referred to first to third gate driving signal output lines 255*a,* 255*b* and 255*c*.

FIG. 5 shows the driving module of the liquid crystal display panel shown in FIG. 4 formed with inspecting patterns according to one embodiment of the present invention.

Referring to FIG. 5, when the image signal is received from the information processing device, the integrated printed circuit board 400 generates the gate driving signal and the data signal so as to display the image corresponding to the image signal.

As mentioned above, the data driving signal generated from the integrated printed circuit board 400 is transferred to the data lines 2, respectively, through the data driving signal input line 330, the data driving IC 320 and the data driving signal output line 340 of the data driving module 300.

The gate driving signal generated from the integrated printed circuit board 400 is transferred to the first gate driving signal input line 253 of the first gate driving module 250*a* through the first gate driving signal transmission line 6*a* formed on the thin film transistor substrate 201. Then, the gate driving signal is supplied to the second gate driving signal transmission line 6*b* formed in the thin film transistor substrate 201 by way of the first gate driving IC 252*a* and the first gate driving signal bypass line 254. In the same manner, the gate driving signal is transferred to the second and third gate driving modules 250*b* and 250*c*. At this time, a plurality of the first gate driving signal input lines 253 are provided. Each of the gate driving signal input line 253 is connected to each first gate driving signal bypass lines 254 in the first gate driving IC 252*a*.

As mentioned above, the gate driving signal generated from the integrated printed circuit board 400 is transferred to the first to third gate driving module 250*a,* 250*b* and 250*c* through the gate driving signal transmission line 4. Then, the gate driving signal is transferred to the gate line 1 through the first to third gate driving signal output lines 255*a,* 255*b* and 255*c* formed between the first to third gate driving ICs 252*a,* 252*b* and 252*c* and the gate line 1 of the thin film transistor substrate 201.

The wiring patterns of first to third gate driving signal transmission lines 6*a,* 6*b* and 6*c* formed on the thin film transistor substrate 201 are integrally formed with the thin film transistor substrate 201 by using the thin film manufacturing process. Accordingly, since the wiring patterns have high contact resistance and intrinsic resistance, the gate driving signal can be modulated. In order to prevent the modulation of the gate driving signal, it is required to enlarge the sectional area of the wiring patterns. However, if the sectional area of the wiring patterns is enlarged, the effective display area of the thin film transistor substrate 201 is reduced. For this reason, intervals between the wiring patterns are closely formed. Accordingly, inspecting patterns are required to check the short-circuit of the closed wiring patterns and the transmitting state of the gate driving signal. FIG. 5 shows the inspecting patterns according to one embodiment of the present invention.

As shown in FIG. 5, first to sixth inspecting patterns 258*a,* 258*b,* 258*c,* 258*d,* 258*e* and 258*f* in the form of point-shaped patterns are formed at parts of the first to third gate driving signal input lines 253, 255 and 257 and the first to third gate driving signal bypass lines 254, 256 and 258. The first to sixth inspecting patterns 258*a,* 258*b,* 258*c,* 258*d,* 258*e* and 258*f* have the area larger than the area of the wiring patterns.

As described above, the first to third gate driving signal input lines 253, 255 and 257 are correspondingly connected to the first to third gate driving signal bypass lines 254, 256 and 258 in the first to third gate driving ICs 252*a,* 252*b* and 252*c,* respectively. Accordingly, the first and second inspecting patterns 258*a,* 258*b,* the third and the fourth inspecting patterns 258*c* and 258*d,* and the fifth and sixth inspecting patterns 258*e* and 258*f* are formed on the wiring patterns that are not overlapped with each other.

In other words, as shown in FIG. 5, the first, third and fifth inspecting patterns 258*a,* 258*c* and 258*e* are formed at an outer portion of the first to third gate driving signal input lines 253, 255 and 257 and the second, fourth and sixth inspecting patterns 258*b,* 258*d* and 258*f* are formed at an inner portion of the first to third gate driving signal bypass lines 254, 256 and 258. The position of the first, third and fifth inspecting patterns 258*a,* 258*c* and 258*e* and the second, fourth and sixth inspecting patterns 258*b,* 258*d* and 258*f* can be reversed.

Figure 6:
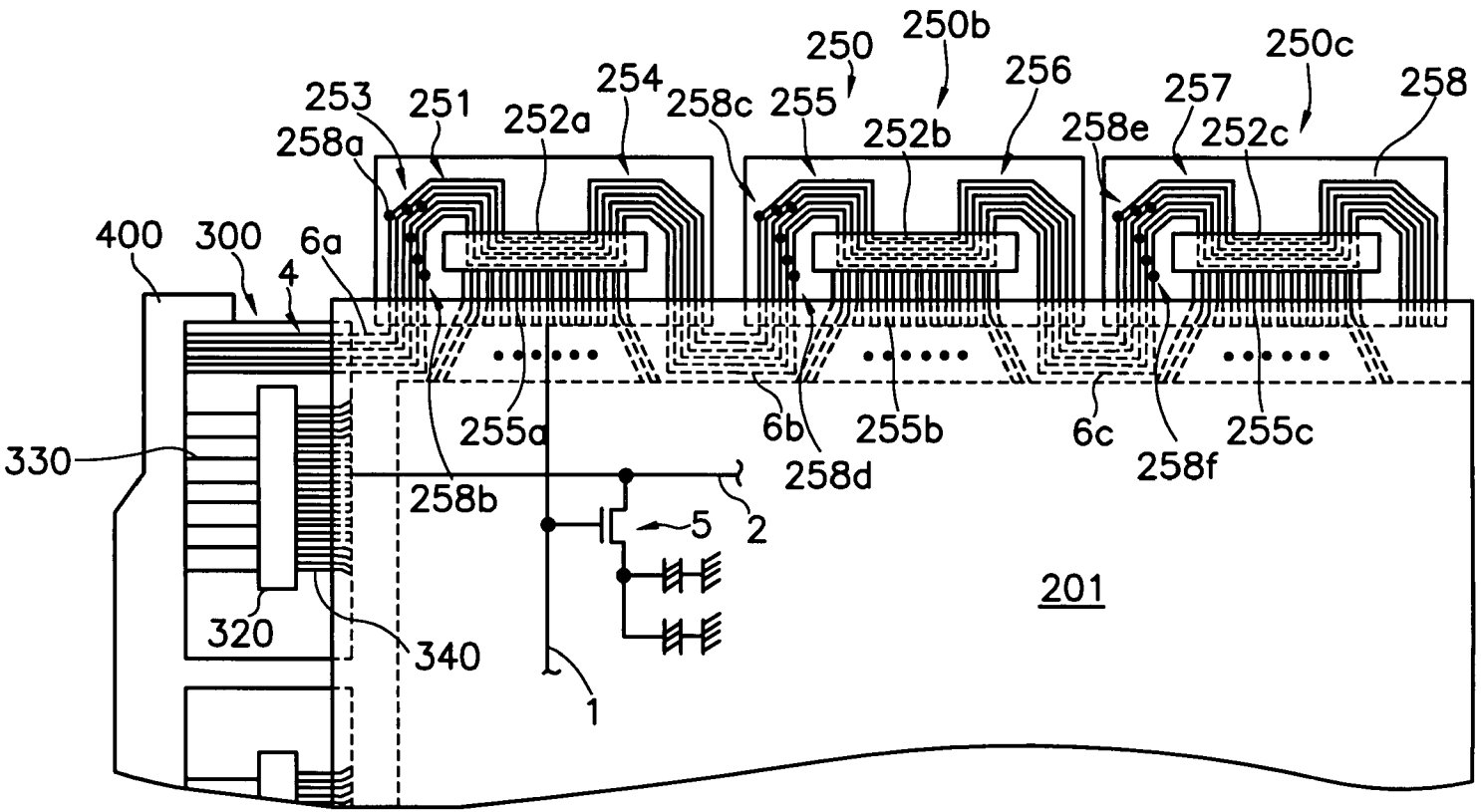
FIG. 6 is a schematic view showing a driving module of the liquid crystal display panel shown in FIG. 4 formed with inspecting patterns according to another embodiment of the present invention.

In addition, it is possible to form the first to sixth inspecting patterns 258*a,* 258*b,* 258*c,* 258*d,* 258*e* and 258*f* only on the first to third gate driving signal input lines 253, 255 and 257. FIG. 6 is a schematic view showing the gate driving module of the liquid crystal display panel shown in FIG. 4 formed with inspecting patterns according to another embodiment of the present invention.

Referring to FIG. 6, the first and second inspecting patterns 258*a* and 258*b,* the third and fourth inspecting patterns 258*c* and 258*d,* and the fifth and sixth inspecting patterns 258*e* and 258*f* are formed on the first to third gate driving signal input lines 253, 255 and 257, respectively. At this time, the inspecting patterns are not formed on the first to third gate driving signal bypass lines 254, 256 and 258, since it is possible to inspect the effectiveness of the gate driving signal and the state of the wiring patterns formed on the first to third gate driving module 250*a,* 250*b* and 250*c* by using the first to sixth inspecting patterns 258*a,* 258*b,* 258*c,* 258*d,* 258*e* and 258*f* formed on the wiring patterns of the first to third gate driving signal input lines 253, 255 and 257.

That is, by checking the first and second inspecting patterns 258*a* and 258*b* by using an inspecting probe, the wiring state of the gate driving signal transmission line 4 from the integrated printed circuit board 400 to the first gate driving signal input line 253 and the effectiveness of the gate driving signal can be checked. In the same manner, by checking the third to sixth inspecting patterns, the wiring state of the remaining portion of the gate driving signal transmission line 4 and the effectiveness of the gate driving signal thereof can be checked.

According to the driving module for the liquid crystal display panel and the liquid crystal display device as described above, the gate driving signal applied to the gate line formed on the thin film transistor substrate is generated from the integrated printed circuit board. The gate driving signal is transmitted to the gate line through the gate driving signal transmission line. The gate driving signal transmission line consists of a plurality of signal transmission lines and is formed on the thin film transistor substrate by passing through the gate driving IC of the gate driving module which is connected to one end of the thin film transistor substrate. In addition, inspecting patterns in the form of point-shaped patterns having the area lager than the area of the signal transmission line are formed on each signal transmission line.

Accordingly, the wiring state of the gate driving signal transmission lines, which are formed in the integrated printed circuit board by passing through the gate driving modules, and the effectiveness of the driving signal supplied to the gate line through the gate driving signal transmission lines can be easily inspected.

While the present invention has been described in detail with reference to the preferred embodiment thereof, it should be understood to those skilled in the art that various changes, substitutions and alterations can be made hereto without departing from the scope of the invention as defined by the appended claims.

What is claimed is:

1. A driving module for applying a driving signal to a display cell circuit formed on a transparent substrate, the driving module comprising:

a flexible board;

a driving circuit mounted on the flexible board;

a driving signal line group which is in electrical communication with the driving circuit (5) and the display cell circuit so as to input/output the driving signal; and inspecting patterns formed on the driving signal line group to inspect the condition of the driving signal line group and the driving signal, wherein the driving signal line group comprises a plurality of driving signal input lines which are formed on the flexible board to provide the driving signal to the driving circuit; a plurality of the driving signal bypass lines which are formed on the flexible board to provide the driving signal supplied from the driving circuit to a next driving circuit; and a plurality of driving signal output lines which are connected to the driving circuit to provide the driving signal supplied from the driving circuit to the display cell circuit, wherein the inspecting patterns include a first inspecting pattern formed at the driving signal input line, and a second inspecting pattern formed at the driving signal bypass line, such that the first inspecting pattern is not electrically connected to the second inspecting pattern.

2. The driving module of claim 1, wherein the driving signal line group is formed on the flexible board disposed at a side of the transparent substrate.

3. The driving module of claim 1, wherein the driving circuit is a gate driving circuit, and the driving signal is a gate driving signal which is applied from the gate driving circuit to a gate of the display cell circuit.

4. The driving module of claim 3, wherein the driving signal input lines, the driving signal bypass lines and the driving signal output lines are gate driving signal input lines, gate driving signal bypass lines, and gate driving signal output lines, respectively.

5. The driving module of claim 4, wherein each of the inspecting patterns is wider than each gate driving signal input line and gate driving signal bypass line.

6. The driving module of claim 1, wherein each of the plurality of driving signal input lines is correspondingly connected to each of the plurality of driving signal bypass lines in the driving circuit.

7. The driving module of claim 6, wherein the inspecting patterns are formed at the plurality of gate driving signal input lines.

8. A liquid crystal display device, comprising:

a liquid crystal display panel having gate lines and data lines and display cell circuits which are connected to the data lines and gate lines respectively, the liquid crystal display panel displaying an image in response to first and second driving signals inputted through the data lines and the gate lines;

an integrated printed circuit board that generates the first and second driving signals;

a plurality of first driving modules which are electrically connected between the integrated printed circuit board and the data lines so as to transmit the first driving signal to the data lines; and a plurality of second driving modules having a plurality of driving signal line groups that are electrically connected to the gate lines, the second driving modules are electrically connected to the integrated printed circuit board through the gate lines formed on the liquid crystal display panel, and the second driving modules transmitting the second driving signal to the gate lines, wherein each of the second driving module comprises a flexible board; a gate driving circuit mounted on the flexible board; a plurality of driving signal line groups in electrical communication with the gate driving circuit and the display cell circuit so as to input/output the gate driving signal; and inspecting patterns formed on the plurality of driving signal line groups for inspecting the condition of the plurality of driving signal line groups and the driving signal, wherein the inspecting patterns include a first inspecting pattern formed at first driving signal lines of the driving signal line groups, and a second inspecting pattern formed at second driving signal lines of the driving signal line groups, such that the first inspecting pattern is not electrically connected to the second inspecting pattern.

9. The liquid crystal display device of claim 8, wherein the plurality of driving signal line groups are formed on the flexible board disposed at a side of the liquid crystal display panel.

10. The liquid crystal display device of claim 8, wherein the first and second driving signals are data and gate driving signals, respectively, and the first and second driving modules are data and gate driving modules, respectively.

11. The liquid crystal display device of claim 8, wherein each of the driving signal line groups comprises:

a plurality of gate driving signal input lines which are formed on the flexible board and provide the gate driving signal to the gate driving circuit;

a plurality of gate driving signal bypass lines which are formed on the flexible board and provide the gate driving signal supplied from the gate driving circuit to a next gate driving circuit; and a plurality of gate driving signal output line which are connected between the gate driving circuit and the gate lines so as to provide the gate driving signal supplied from the gate driving circuit to the gate lines.

12. The liquid crystal display device of claim 11, wherein each of the plurality of gate driving signal input lines is correspondingly connected to each of the plurality of gate driving signal bypass lines in the gate driving circuit.

13. The liquid crystal display device of claim 12, wherein the inspecting patterns are formed at the plurality of gate driving signal input lines.

14. The liquid crystal display device of claim 11, wherein the each of the inspecting patterns is wider than each gate driving signal input line and gate driving signal bypass line.

15. A display apparatus, comprising:

a transistor substrate;

integrated printed circuit board arranged adjacent to the transistor substrate;

a first driving module having a first end and a second end, the first end connected to the integrated print circuit board and the second end connected to the transistor substrate, wherein the first driving module includes a plurality of signal transmission line, and a second driving module having a first end and a second end, the first end connected to the transistor substrate, where the driving module comprises a plurality of input signal lines in electrical communication with the plurality of signal transmission lines, and a plurality of signal bypass lines which are formed on the flexible board to provide the driving signal supplied from the second driving module to a third driving module have a first end and second end, the first end connected to the transistor substrate, and a portion of the plurality of input signal lines and signal bypass lines includes inspecting patterns to allow for inspection of an electrical signal in plurality of input signal lines;

wherein the inspecting patterns include a first inspecting pattern formed at the driving signal input line, and a second inspecting pattern formed at the driving signal bypass line, such that the first inspecting pattern is not electrically connected to the second inspecting pattern.

16. A driving module applying a driving signal to a display cell circuit formed on a transparent substrate, the driving module comprising:

a flexible board;

a driving circuit mounted on the flexible board;

a driving signal line group which is in electrical communication with the driving circuit and the display cell circuit so as to input/output the driving signal; and inspecting patterns formed on the driving signal line group to inspect the driving signal line group and the driving signal, wherein the inspecting patterns include a first inspecting pattern formed at first driving signal lines of the driving signal line group, and a second inspecting pattern formed at second driving signal lines of the driving signal line group, such that the first inspecting pattern is not electrically connected to the second inspecting pattern.

17. The driving module of claim 16, wherein the driving signal line group is formed on the flexible board disposed at a side of the transparent substrate.

18. The driving module of claim 17, wherein the first and second driving signal lines are the driving signal input lines and the driving signal bypass lines, respectively.

19. The driving module of claim 16, wherein the driving circuit is a gate driving circuit, and the driving signal is a gate driving signal which is applied from the gate driving circuit to a gate of the display cell circuit.

20. The driving module of claim 16, wherein the driving signal line group comprises:

a plurality of driving signal input lines which are formed on the flexible board to provide the driving signal to the driving circuit;

a plurality of driving signal bypass lines which are formed on the flexible board to provide the driving signal supplied from the driving circuit to a next driving circuit; and a plurality of driving signals output lines which are connected to the driving circuit to provide the driving signal supplied from the driving circuit to the display cell circuit.

* * * * *